US006272749B1

(12) United States Patent
Boeshart et al.

(10) Patent No.: US 6,272,749 B1
(45) Date of Patent: Aug. 14, 2001

(54) CAST-IN-PLACE CONCRETE DECK SYSTEM

(75) Inventors: Patrick E. Boeshart, Sioux City, IA (US); Thomas J. Devine, Watertown, SD (US)

(73) Assignee: Lite-Form International, Sioux City, IA (US)

( * ) Notice: Subject to any disclaimer, the term of this patent is extended or adjusted under 35 U.S.C. 154(b) by 0 days.

(21) Appl. No.: 09/439,676

(22) Filed: Nov. 15, 1999

(51) Int. Cl.[7] ..... B21D 47/00

(52) U.S. Cl. ..... 29/897.32; 29/897.34; 52/220.2; 52/323

(58) Field of Search ..... 29/897.32, 897.3, 29/897.34, 897.1, 432.1; 83/16, 39, 56; 264/158, 138, 152; 52/323, 414, 309.2, 592.1, 309.16, 220.2, 220.3, 220.1, 578

(56) References Cited

U.S. PATENT DOCUMENTS

| | | | | |
|---|---|---|---|---|
| 1,573,280 | * | 12/1998 | Simpson | 52/323 |
| 1,747,294 | * | 2/1930 | Coldsmith | 52/323 |
| 3,699,622 | * | 10/1972 | Frydenberg | 29/897.32 |
| 4,085,558 | * | 4/1978 | Albrecht | 29/897.32 |
| 5,799,462 | * | 9/1998 | Mckinney | 29/897.32 |
| 5,842,276 | * | 12/1998 | Asher et al. | 29/897.32 |
| 5,893,248 | * | 4/1999 | Beliveau | 52/309.2 |
| 5,943,775 | | 8/1999 | Lanahan et al. . | |
| 6,085,485 | * | 7/2000 | Murdock | 52/309.16 |

FOREIGN PATENT DOCUMENTS

| | | | |
|---|---|---|---|
| 312482A1 | * | 4/1989 | (EP) . |
| 0693597A1 | | 1/1996 | (EP) . |
| 0551276B1 | | 12/1997 | (EP) . |
| 2604201A1 | * | 3/1988 | (FR) . |
| WO9816703 | | 4/1998 | (WO) . |

* cited by examiner

*Primary Examiner*—I Cuda Rosenbaum
*Assistant Examiner*—Trinh Nguyen
(74) *Attorney, Agent, or Firm*—Koley Jessen P.C. A Limited Liability Organization; Mark D. Frederiksen

(57) ABSTRACT

A method of manufacturing a concrete deck form panel includes the initial step of cutting an insert within the panel, which may be removed by sliding the insert longitudinally from the panel. A pair of structural members are attached to the longitudinal sides of the insert, and then the insert is returned to the original position within the panel. A series of panels are connected to form a floor for supporting concrete, thereby forming a concrete deck system. In a second embodiment of the invention each form panel is formed by attaching a pair of structural members to longitudinal sides of a central body and then attaching L-shaped members to the structural members. A top plate is mounted to the top of the L-shaped members and the central body to form the integrated form panel.

7 Claims, 5 Drawing Sheets

CAST-IN-PLACE CONCRETE DECK SYSTEM

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to form structures utilized for cast-in-place concrete roof and floor decks, and more particularly to self-supporting form structures which are interconnectable to provide a continuous insulated concrete deck system.

(2) Background Information

It is well known in the industry to utilize expanded plastic forms for the construction of poured concrete walls and the like. The expanded plastic forms may either be removed or left in place after the concrete has hardened to provide thermal and sound insulation properties.

A relatively recent adaptation of expanded plastic form structures is disclosed in PCT patent application No. PCT/EP 97/05671, owned by Plastedil S. A. This application discloses a self-supporting construction element made of expanded plastic material which is extruded with steel studs embedded therein. Each panel is molded with a steel stud embedded therein during the molding process. The panels may then be cut to a desired length and interconnected to form a floor upon which concrete may be poured. A lath for supporting at least one layer of a covering material is fastened to the reinforcing bar in the panel, the lath providing fire resistant properties to the panel.

While the Plastedil structure has provided a new system for forming cast and place concrete decks, it suffers several problems.

The equipment needed to mold the plastic panel with the steel reinforcing bar therein is expensive and complicated. Because of the expense and time involved in creating the panels, the cost of using the system can also be prohibitively expensive.

BRIEF SUMMARY OF THE INVENTION

It is therefore a general object of the present invention to provide an improved cast and place concrete deck system.

Another object is to provide self-supporting expanded plastic panels for a concrete deck system which include reinforcing bars, but are simple and inexpensive to manufacture.

Still another object of the present invention is to provide a cast and place concrete deck system which utilizes standard off-the-shelf components and common machinery for the formation of the panel.

These and other objects will be apparent to those skilled in the art.

The method of manufacturing a concrete deck form panel of the present invention includes the initial step of cutting an insert within the panel, which may be removed by sliding the insert longitudinally from the panel. A pair of structural members are attached to the longitudinal sides of the insert, and then the insert is returned to the original position within the panel. A series of panels are connected to form a floor for supporting concrete, thereby forming a concrete deck system. In a second embodiment of the invention each form panel is formed by attaching a pair of structural members to longitudinal sides of a central body and then attaching L-shaped members to the structural members. A top plate is mounted to the top of the L-shaped members and the central body to form the integrated form panel.

BRIEF DESCRIPTION OF THE SEVERAL VIEWS OF THE DRAWING

The invention is illustrated in the accompanying drawing, in which similar, or corresponding parts are identified with the same reference numeral throughout the several views, and in which.

DETAILED DESCRIPTION OF THE INVENTION

Figure 3:
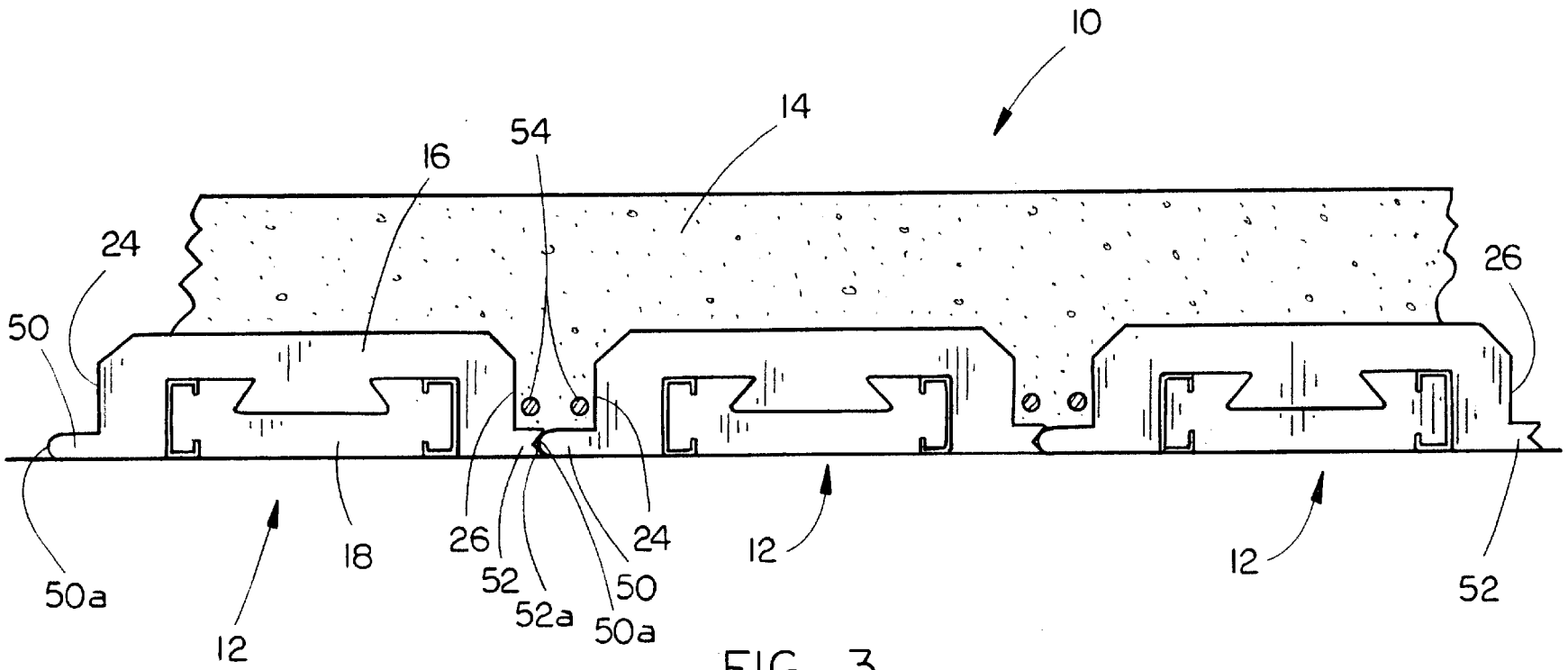
FIG. 3 is a cross-sectional view through a deck system with the form panels and concrete cast-in-place.

Referring now to the drawings, and more particularly to FIG. 3, the cast-in-place concrete deck system of the present invention is designated generally at 10 and shows a plurality of form panels 12 interconnected to form a continuous floor or upon which concrete 14 is poured and permitted to harden to form a continuous, insulated concrete deck for roofs and floors.

Initially, a plurality of panels 12 are cut from a rectangular block of expanded polystyrene with a hot wire apparatus. Preferably, the main body 16 and associated insert 18 are cut simultaneously with a plurality of hot wires passing through the block of polystyrene.

Figure 1:
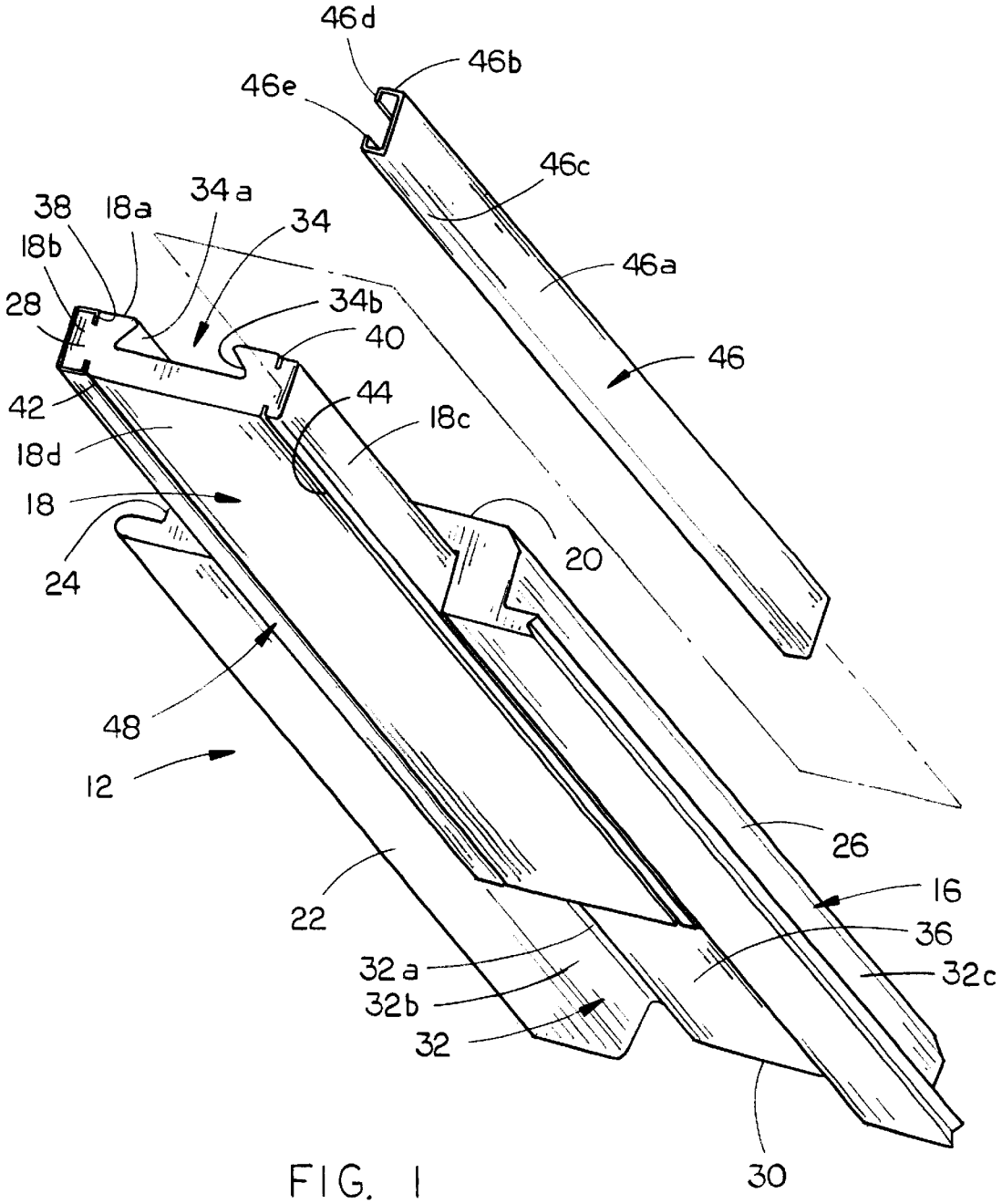
FIG. 1 is an exploded perspective view of one form panel of the present invention, with an insert portion slid outwardly from the form panel with a C-shape structural member removed therefrom.

Each panel 12 includes main body 16 having upper and lower faces 20 and 22, opposing longitudinal sides 24 and 26 and opposing ends 28 and 30, as shown in FIG. 1. The hot wire apparatus cuts through the polystyrene block to form insert 18 separate and removable from main body 16. When insert 18 is removed, it can be seen that the hot wire apparatus thereby form a channel, designated generally at 32, in the lower face 22 of main body 16. Channel 32 includes an upper wall 32*a* and a pair of opposing side walls 32*b* and 32*c*. Insert 18 includes an upper wall 18*a* and opposing side walls 18*b* and 18*c* which correspond with the channel upper and side walls 32*a, b,* and *c* respectively. The lower wall 18*d* of insert 18 is coplanar with the lower face 22 of the panel main body 16.

In the preferred embodiment of the invention, insert 18 includes a slot 34 formed in the upper wall 18*a* and extending longitudinally from end to end. The upper wall 32*a* of channel 32 has a depending leg 36 (seen more clearly in FIG. 2) which extends from end to end of body 16, and has a shape corresponding with the shape of slot 34. Preferably, leg 36 has side walls 36*a* and *b* which slope outwardly to form a dove tail configuration in cross-sectional view. Similarly, the side walls 34*a* and 3*b* of slot 34 slope inwardly (as seen in FIG. 1) to permit slidable movement of insert 18 longitudinally along channel 32, but prevent insert 18 from being withdrawn vertically downwardly off of leg 36.

After insert 18 has been cut and removed from main body 16, a pair of upper slots 38 and 40 and a pair of lower slots 42 and 44 are cut along the length of insert 18 parallel to side walls 18*b* and 18*c,* with upper and lower slots 38 and 42 diametric, and upper and lower slots 40 and 44 diametric. As shown in FIG. 1, each pair of upper and lower slots 38, 42 and 40, 44 are spaced from the associated side wall 18*b* and 18*c* a distance to receive the upper and lower lips of a C-shaped channel therein.

FIG. 1 shows structural member 46 exploded from insert 18, prior to attachment to the insert, and structural member 48 engaged on side wall 18*b* of insert 18. In the preferred form of the invention, structural members 46 and 48 are C-shaped channels having a web portion 46*a,* upper and lower flanges 46*b* and 46*c,* and upper and lower lips 46*d* and 46*e,* all extending the length of insert 18. Slots 38, 40, 42, and 44 are preferably cut with circular saw blades, the blade having a thickness substantially the same as the lips of the structural members 46 and 48, so that the structural members 46 may be slid the length of insert 18 with the lips engaging the slots, and the structural members 46 and 48 engaging the side walls 18*c* and 18*b* respectively of insert 18.

Figure 2:
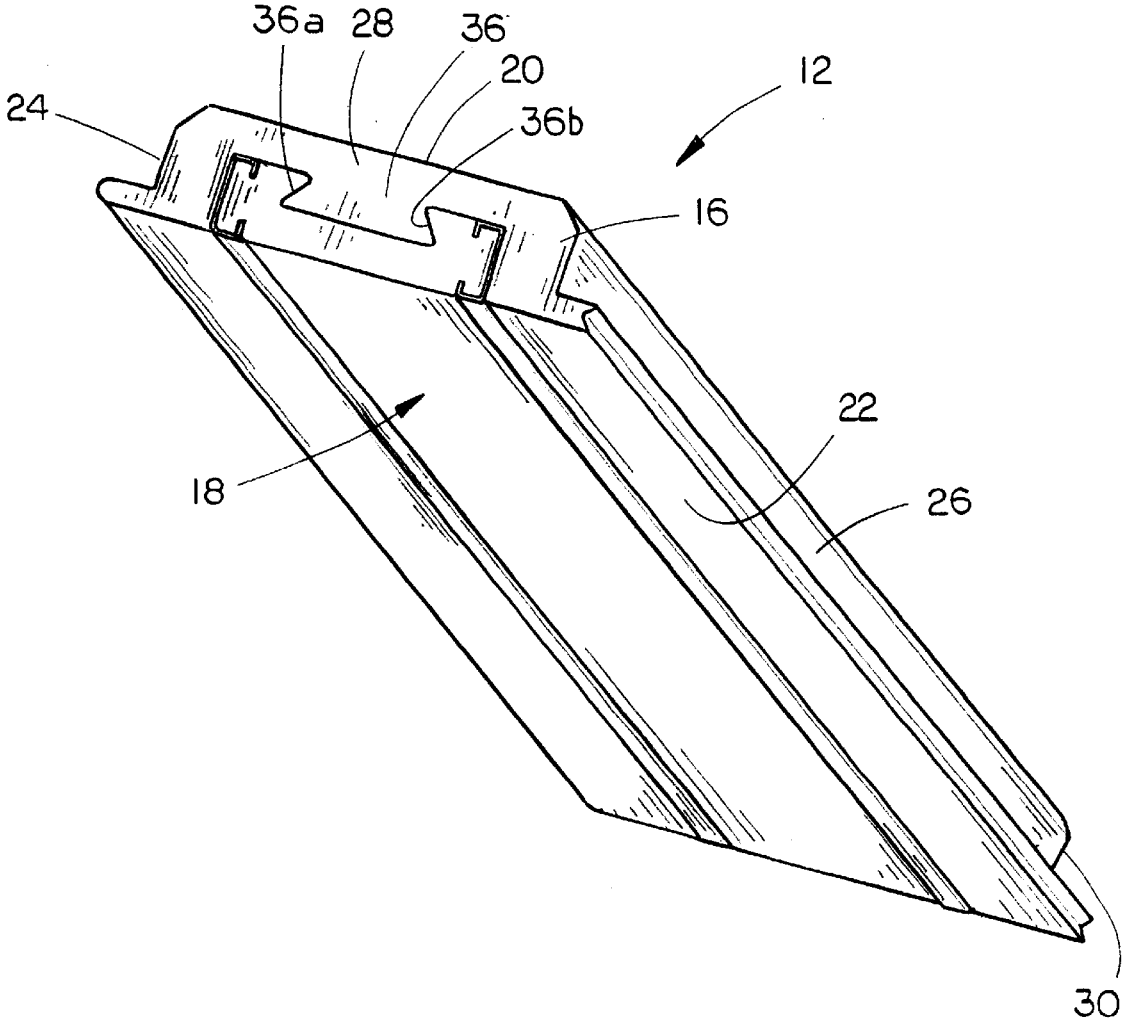
FIG. 2 is a perspective view similar to FIG. 1, with the insert and one structural member in position, and one structural member slid outwardly from the insert.

Once structural members 46 and 48 are engaged on insert 18, the insert is positioned with slot 34 engaging leg 36, and slid into position with the ends of the insert flush with the ends of main body 16, as shown in FIG. 2. Obviously, other configurations for leg 36 and channel 34 may be utilized which will permit the slidable engagement of insert 18 into main body 16.

Referring once again to FIG. 3, it can be seen that each side wall 24 and 26 of panels 12 includes an elongated ledge 50 and 52 respectively. Each ledge 50 has a ridge 50*a* formed along the length thereof which will be received in and engage a valley 52*a* extending along the length of an adjacent ledge 52. In this way, the space between adjacent side walls 24 and 26 of adjacent panels 12 are spaced apart to form a general "T-shape" in concrete 14. Reinforcing steel 54 is preferably positioned in this portion of the concrete, for strength.

Once panels 12 are positioned with the adjacent ledges 50 and 52 in engagement, concrete 14 is poured over the top of the panels, to form a concrete deck.

Figure 4:
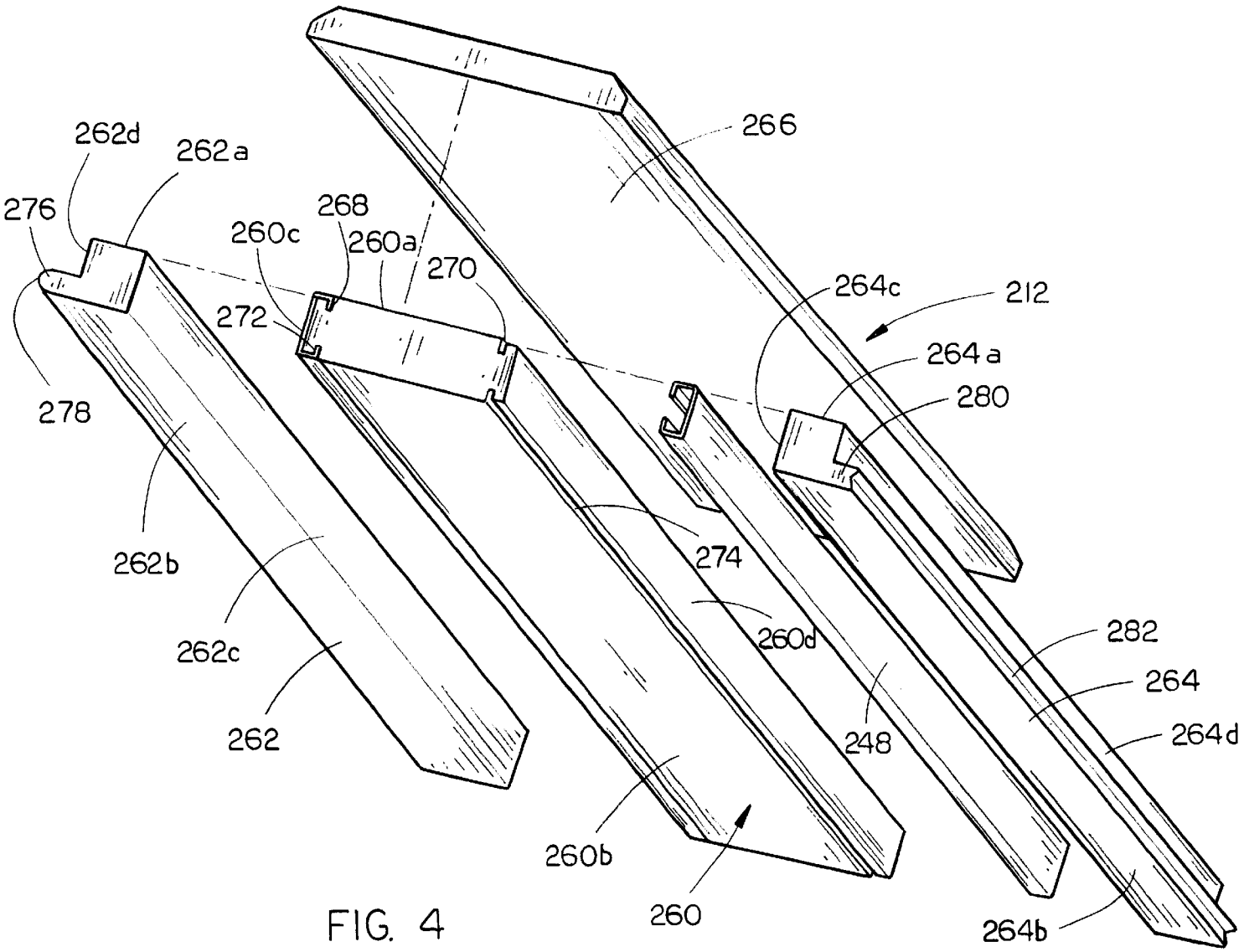
FIG. 4 is an exploded perspective view of a second embodiment of the form panel of the present invention.
Figure 5:
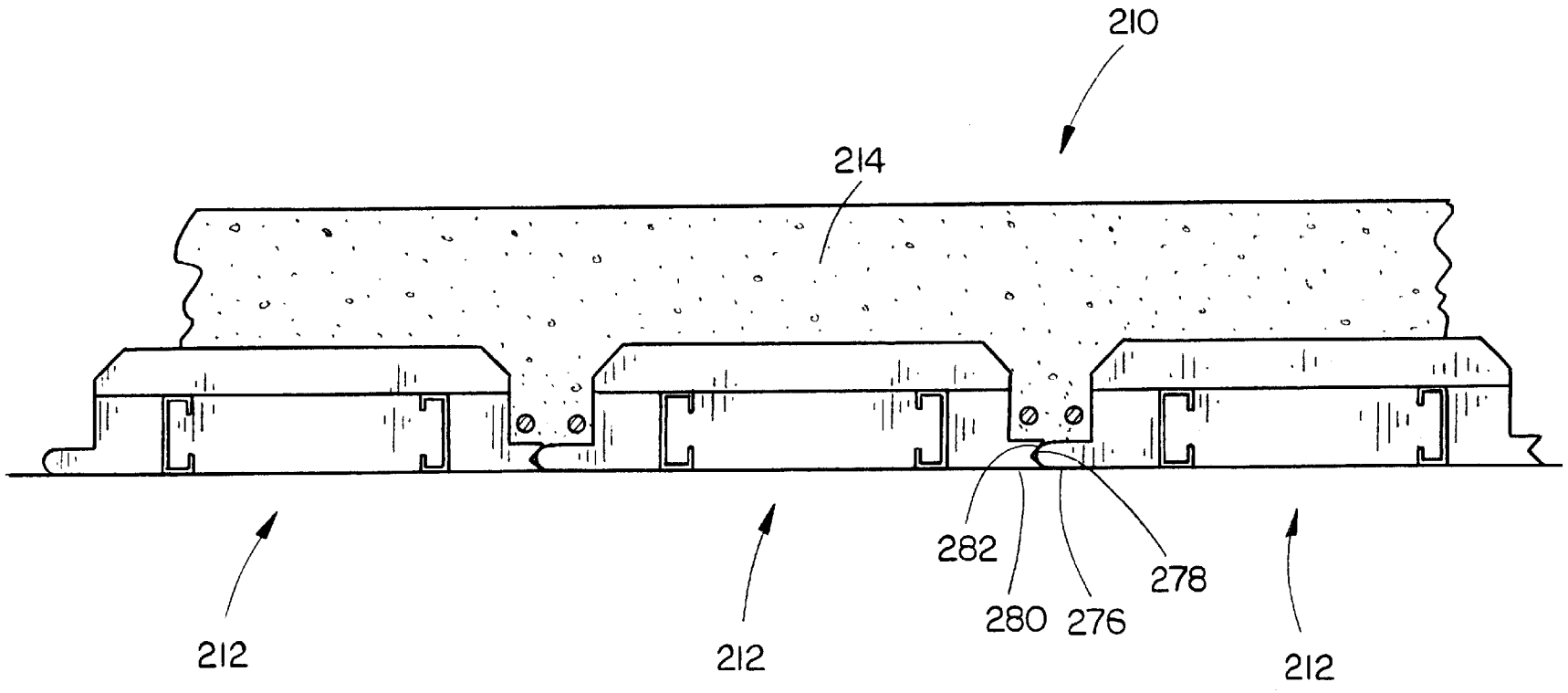
FIG. 5 is a sectional view through a deck system with the form panels of the second embodiment of the invention and concrete cast-in-place.

Referring now to FIGS. 4 and 5, a second embodiment of the cast-in-place deck system of the present invention is designated generally at 210, and includes a plurality of panels 212 having an identical cross-sectional configuration as panels 12 found in the first embodiment of the invention. The panels 212 are simply assembled with a different process than panels 12 of the first embodiment.

Each panel 212 is an assembly of four pieces: a central body 260, a pair of L-shaped members 262 and 264, and a top plate 266. Structural members 246 and 248 may be identical to those used in the first embodiment of the invention, such as a C-shaped channel shown in the drawings.

The first step in the process of assembling panel 212 includes the step of cutting a pair of upper slots 268 and 270, and a pair of lower slots 272 and 274 in the upper and lower faces 260*a* and 260*b* of central body 260. One pair of upper and lower slots 268 and 272 are diametric, and parallel to side wall 260*c* of central body 260, while upper and lower slots 270 and 274 are diametric and parallel in adjacent side wall 260*d* of central body 260. The lips of C-shaped channels 246 and 248 will slide within slots 268, 270, 272, and 274, such that the channels will engage the side walls 260*c* and 260*d* when positioned on central body 260.

In the preferred form of the embodiment, central body 260 is a standard size sheet of expanded polystyrene material, so that no cutting is necessary to produce the central body 260. If necessary, a large sheet of material may be cut into the desired width of central body 260, although the length and thickness of the central body 260 would be equal to that of the standard sheet.

Similarly, L-shaped members 262 and 264 have a thickness between upper and lower faces 262*a* and 262*b* and 264*a* and 264*b* respectively which is equal to the standard thickness of the polystyrene foam material. L member 262 includes a flat vertical inward face 262*c* and is cut to produce a ledge 276 projecting from the outward face 262*d,* to form the L-shape. Ledge 276 includes a ridge 278 extending the length thereof.

L member 264 also has a flat vertical inward face 264*c* and an outward face 264*d* with a ledge 280 projecting therefrom with a valley 282 formed along the length of ledge 280.

As shown in FIG. 5, the ridge 278 of ledge 276 will engage the valley 282 of an adjacent ledge 280 to form a floor which will support concrete between a pair of panels 212. Thus, once concrete 214 has been poured, a T-shaped leg will be formed between the side walls of each form panel 212.

Referring again to FIG. 4, once structural members 246 and 248 have been attached to central body 260, L members 262 and 264 are attached to the web portions of structural members 246 and 248 respectively. This is preferably accomplished by applying adhesive to the inward faces 262*c* and 264*c* of L members 262 and 264 and affixing them directly to structural members 246 and 248 respectively.

Once L members 262 and 264 are attached to central body 260, top plate 266 is provided from a standard thickness of expanded polystyrene foam material, cut to a width to extend across the entirety of the upper face of central body 260 and the upper faces of L members 262 and 264. Top plate 266 is mounted to central body 260 and L members 262 and 264 with the same type of adhesive used to attach the L members to the central body.

Whereas the invention has been shown and described in connection with the preferred embodiments thereof, many modifications, substitutions and additions may be made which are within the intended broad scope of the appended claims.

We claim:

1. A method of manufacturing a form panel with structural reinforcements, comprising the steps of:

cutting a panel of expanded polystyrene material having upper and lower faces, opposing longitudinal sides and opposing ends, to form a removable insert in said panel, the insert having a lower face coplanar with the panel lower face, longitudinal sides inward of the panel longitudinal sides, and an upper face intermediate the panel upper and lower faces, and extending from end to end of the panel;

removing the insert from the panel, leaving a downwardly opening channel formed in the panel lower face;

attaching a first structural member having an elongated web to one longitudinal side of the insert with web in flush contact with the web in flush contact with the insert first side;

attaching a second structural member having an elongated web to the other longitudinal side of the insert with the second structural member web in flush contact with the insert second side; and reinstalling the insert in the panel channel such that the insert lower face is coplanar with the panel lower face and the insert ends are lined with the panel ends.

2. The method of claim 1 wherein said first and second structural members have an upper flange extending the length of the respective web, each flange extending at an angle relative to the associated web which is equal to the angle between the insert top face and the insert sides placed in contact with the associated webs, and wherein the steps of attaching the structural members includes attaching the structural members with the flanges in flush contact with the insert upper face.

3. The method of claim 2, wherein each said structural member further includes a lip extending the length of the respective flange and generally perpendicular thereto; and further comprising the step of cutting a pair of slots in the upper face of the insert, parallel to the sides and located to receive a structural member lift therein; and wherein the steps of attaching the structural members to the insert includes inserting the lips within the slots in the insert upper face.

4. The method of claim 3, wherein each structural member includes a second flange parallel to the first flange, and a second lip coplanar with the first lip, to form a generally C-shape structural member;

further comprising the step of cutting a pair of slots in the lower face of the insert, coplanar with the first pair of slots; and wherein the steps of attaching the structural members to the insert includes inserting the second pair of lips into the second pair of slots.

5. The method of claim 4, wherein the steps of attaching the structural members to the insert includes the steps of:

engaging one end of each structural member on one end of the insert; and sliding the structural members into complete engagement on the insert with the ends of the structural members generally aligned with the ends of the insert.

6. The method of claim 5, wherein the cutting step includes cutting the panel to form the insert with sides shaped to permit only slidable movement of the insert in a longitudinal direction relative to the panel.

7. The method of claim 6, wherein the cutting step further includes cutting a plurality of panels from a block of expanded polystyrene material simultaneously with the cutting of the panel.

* * * * *